US008406088B2

(12) United States Patent
Pesenti

(10) Patent No.: US 8,406,088 B2
(45) Date of Patent: Mar. 26, 2013

(54) TORQUE MEASURING DEVICE FOR STOPPING A STRIKING WORK

(75) Inventor: Jean-François Pesenti, Morbier (FR)

(73) Assignee: Montres Breguet SA, L'Abbaye (CH)

( * ) Notice: Subject to any disclaimer, the term of this patent is extended or adjusted under 35 U.S.C. 154(b) by 203 days.

(21) Appl. No.: 13/041,868

(22) Filed: Mar. 7, 2011

(65) Prior Publication Data

US 2011/0216633 A1 Sep. 8, 2011

(30) Foreign Application Priority Data

Mar. 5, 2010 (EP) ..... 10155665

(51) Int. Cl.
*G04B 25/00* (2006.01)

(52) U.S. Cl. ..... 368/273; 368/244

(58) Field of Classification Search ..... 368/244, 368/273

See application file for complete search history.

(56) References Cited

U.S. PATENT DOCUMENTS

| | | | | |
|---|---|---|---|---|
| 325,854 | A * | 9/1885 | Morlet | 368/268 |
| 383,256 | A | 5/1888 | Stauffer | |
| 383,266 | A * | 5/1888 | Stauffer | 12/33 |
| 4,466,744 | A * | 8/1984 | Hepfer et al. | 368/262 |
| 2008/0008052 | A1 * | 1/2008 | Moteki | 368/260 |

FOREIGN PATENT DOCUMENTS

| | | |
|---|---|---|
| CH | 14979 | 7/1897 |
| EP | 1 429 214 | 6/2004 |
| EP | 1 708 050 | 10/2006 |
| EP | 1 760 545 | 3/2007 |
| EP | 1 925 994 | 5/2008 |
| EP | 1 925 997 | 5/2008 |
| GB | 361 232 | 11/1931 |

OTHER PUBLICATIONS

Francois Lecoultre, "Les montres compliquées" (Complicated Watches) (ISBN, 2-88175-000-1) 56 pages.

European Search Report issued in corresponding application 10 15 5665, completed Aug. 30, 2010.

* cited by examiner

*Primary Examiner* — Sean Kayes
(74) *Attorney, Agent, or Firm* — Greffin & Szipl, P.C.

(57) ABSTRACT

The invention concerns a torque measuring device (10) for stopping the strike of a striking mechanism. The torque measuring device (10) includes a torque measuring lever (1), whose trajectory interferes with that of a strike wheel (11) and which is arranged to be pivoted by the strike wheel, and the torque measuring lever (1) is subject to a resistant force of determined value against a drive force exerted by the strike wheel (11) during the rotation thereof, and the torque measuring lever (1) blocks the rotation of the strike wheel if the drive force is less than the resistant force, and if the torque measuring lever does not allow the strike wheel to rotate. The invention also concerns a striking mechanism including a torque measuring device (10) of this type. The invention further concerns a timepiece incorporating a striking mechanism of this type.

15 Claims, 2 Drawing Sheets

TORQUE MEASURING DEVICE FOR STOPPING A STRIKING WORK

This application claims priority from European Patent Application No. 10155665.2 filed Mar. 5, 2010, the entire disclosure of which is incorporated herein by reference.

FIELD OF THE INVENTION

The present invention concerns a device for measuring torque for stopping the strike of a striking mechanism including a rechargeable energy source and a striking pallet which, at times planned by said mechanism and/or the user thereof, allows at least one strike wheel to be driven using part of the energy transmitted by said energy source to actuate at least one hammer on at least one gong.

The invention also concerns a strike mechanism including a rechargeable energy source and a striking pallet which, at times planned by said mechanism and/or the user thereof, allows at least one strike wheel to be driven using part of the energy transmitted by said energy source to cause at least one gong to resonate, and including at least one such torque measuring device.

The invention also concerns a timepiece including at least one such strike mechanism.

The invention concerns the field of timepiece striking mechanisms.

STATE OF THE PRIOR ART

The recurring problem in an automatic strike device is that, if the strike barrel does not deliver the torque necessary to perform the entire strike sequence, the strike will not be carried out completely, or will not be released at the exact time, which is more serious.

A practical solution has never been found to this recurrent problem.

Timepieces with an improved striking mechanism have been known for a long time, in particular within the field of "complicated" watches, such as repeater watches or grand strike watches. For a better understanding of the state of the art within the field of complicated watches, reference may be made to the work of Francois Lecoultre entitled "*Les montres compliquées*" (Complicated Watches) (ISBN, 2-88175-000-1), which notably includes several chapters relating to watches fitted with a striking mechanism (pages 97 to 205).

Within the field of striking mechanisms, devices which prevent the striking work from operating during time-setting are known, for example from CH Patent No 14,979, in the name of John Meylan, disclosing an isolator device devised for this purpose, or from EP Patent No. 1 429 214 B1 in the name of Daniel Roth and Gerald Genta Haute Horlogerie SA, which includes means for locking a rocking bar as soon as a particular movable part of the striking mechanism is moved away from its idle or rest position.

EP Patent No. 1 925 997 in the name of Christophe Claret SA discloses a striking mechanism with an energy source for driving the racks by a strike drive device. The latter is arranged in a gear train connecting the energy source to a regulating member. The strike drive device is arranged in the gear train and actuated by a control member. The racks cooperate with snails to extract information as to the current time. The control member is a cam shaft cooperating with the drive device via a connecting element and via a drive wheel set to pivot the cam shaft when the striking work is released. The pivoting of this cam shaft is blocked by a bolt, controlled by a lever fitted with a spring loaded feeler pin cooperating with a cam characteristic of a predetermined power reserve limit threshold of the barrel.

EP Patent No. 1 708 050 in the name of Zenith International SA discloses a striking mechanism, which includes a gear train completing one revolution in a duration equal to the barrel power reserve. This gear train carries a cam on the arbour thereof, which, when the barrel power reserve is insufficient to complete an entire minute repeater cycle, is positioned so as to intersect the finger-piece of a lever which is actuated by a push button to cooperate with a locking lever of a wheel with wolf-teeth for holding the barrel in the wound position.

GB Patent No 361 232 in the name of Junghans Geb AG discloses a screw-nut mechanism linked to the unwinding of a periodically wound electric driving spring, for locking the striking mechanism when the barrel has unwound to a predetermined value.

EP Patent No. 1 760 545 in the name of Montres Journe SA discloses the release of a striking work, which requires disconnecting a connecting lever in order to unlock the strike racks and allow each to extract information from an appropriate cam. A locking system prevents this connecting lever from being disconnected when the power reserve of the barrel is lower than a given threshold.

However, no known device has been marketed with the function of monitoring the potential of the strike barrel, i.e. the power reserve of the striking work.

SUMMARY OF THE INVENTION

The invention proposes to overcome the problem of strike sequences that are incomplete or out of phase relative to the theoretical position thereof, by permanently monitoring the power reserve of the striking work, and locking the striking work as soon as the drive potential of the striking mechanism is insufficient for proper operation.

The invention therefore concerns a torque measuring device for stopping the strike of a striking mechanism including a rechargeable energy source and a striking pallet, which, at times planned by said mechanism and/or the user thereof, allows at least one strike wheel to be driven using part of the energy transmitted by said energy source to actuate at least one hammer on at least one gong, characterized in that it includes at least one movable torque measuring lever, whose trajectory interferes with that of a strike wheel, and which is arranged to be driven by said strike wheel, said torque measuring lever being permanently subject to a resistant force of determined value against a drive force exerted on said torque measuring lever by said strike wheel during the rotation thereof, and said torque measuring lever blocking the rotation of said strike wheel if said drive force is less than said resistant force of determined value, and otherwise allowing said strike wheel to rotate by releasing said wheel.

According to a feature of the invention, said resistant force is applied to said torque measuring lever by a arm a support spring.

The invention also concerns a striking mechanism including a rechargeable energy source and a striking pallet, which, at times planned by said mechanism and/or the user thereof, allows at least one strike wheel to be driven using part of the energy transmitted by said energy source to actuate at least one hammer on at least one gong, and including at least one such torque measuring device.

The invention also concerns a timepiece including at least one such strike mechanism.

The invention has the advantage of either enabling the strike sequence to occur properly in its entirety at the planned time, or locking the striking mechanism until it is rewound.

DESCRIPTION OF THE DRAWINGS

Other features and advantages of the present invention will appear more clearly from the following detailed description of an example embodiment of the correction mechanism according to the invention, this example being given solely by way of non-limiting illustration with reference to the annexed drawings, in which.

DETAILED DESCRIPTION OF THE INVENTION

The invention concerns the field of timepiece striking mechanisms.

The invention concerns a torque measuring device 10 for stopping the strike of a striking mechanism. This striking mechanism includes, in a conventional manner, at least one rechargeable energy source, such as a strike spring, coil or suchlike, or a set of weights, or suchlike, which is intended to drive at least a single strike wheel 11 or multiple strike wheels. Whether the energy source is mechanical, electrical or of another type, it is an object of the invention to prevent the strike cycle from continuing improperly in the event that the drive force supplied by the energy source is insufficient, until said source is recharged to a sufficient level of energy for the striking mechanism to operate properly. Strike wheel 11 includes a cam path for each strike gong to be operated. The invention is described here in the particular application to timepieces which have a mechanical energy source using a spring for the striking work. It is clear that it applies equally to clocks wherein the energy source is formed by weights, or to electrical, hydraulic or other energy sources, and will not be specifically described for these particular applications.

Figure 1:
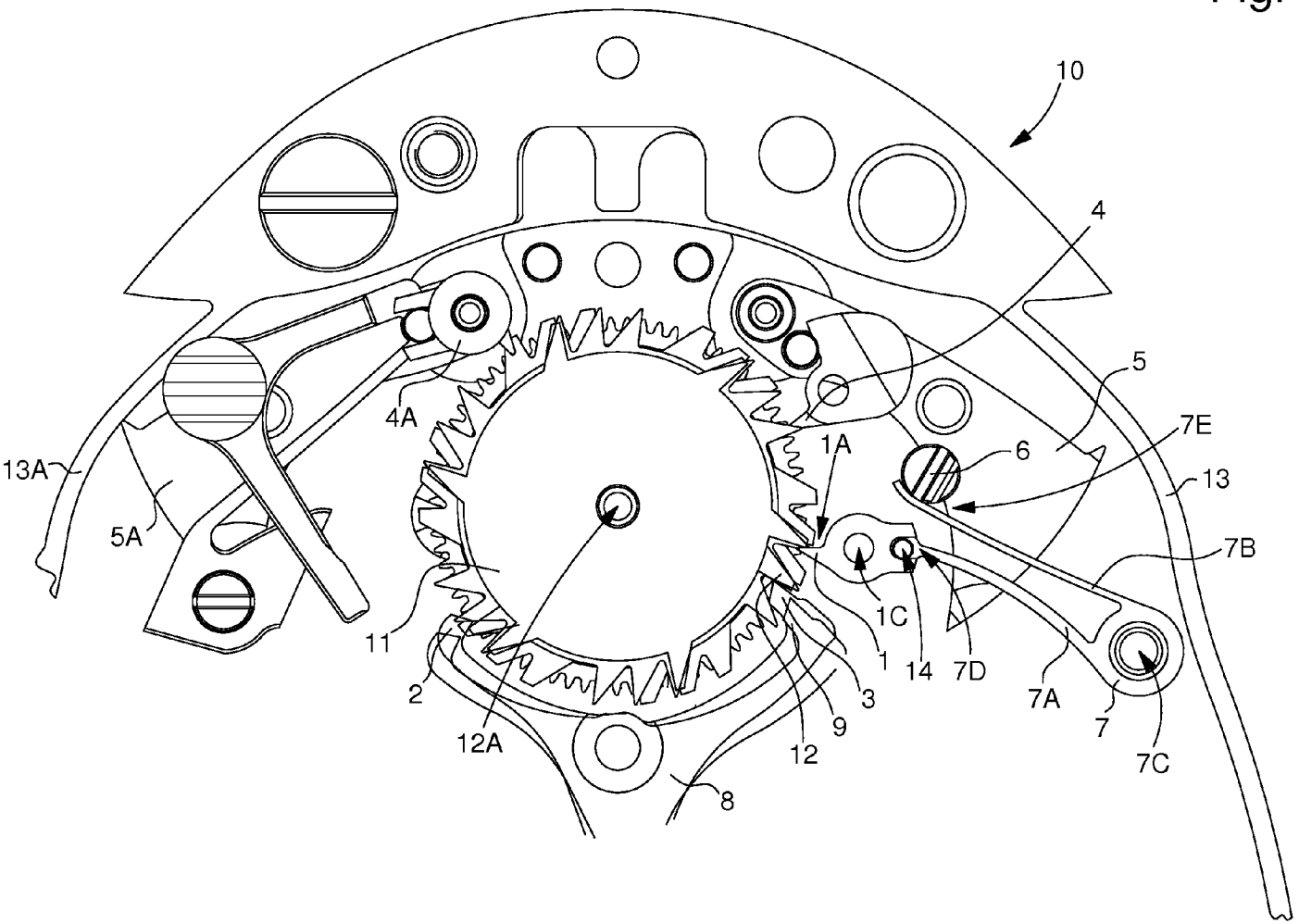
FIG. 1 shows schematically in a partial plan view, a striking mechanism for a timepiece including a torque measuring device according to the invention, in a first preferred embodiment.

The striking mechanism includes a striking pallet 8, which, at times planned by the mechanism and/or the user thereof, allows at least one strike wheel 11 to be driven using part of the energy transmitted by the energy source to actuate at least one hammer on at least one gong 13, to cause said gong to resonate. The strike striking pallet 8 has a trajectory that interferes with that of strike wheel 11 and prevents the latter from rotating at any time other than a time planned by the timepiece movement, or planned by the user in the case of an alarm, this planned time being also called the "exact time" hereinafter. At this planned time, strike striking pallet 8 releases strike wheel 11, and allows said wheel to rotate. This strike striking pallet 8 includes a stop member which may formed by a trigger tooth 9 as seen in the Figures, or by a pivoting part, wheel or other element. In FIG. 1, which illustrates the example of a striking mechanism with two gongs 13 and 13A, the striking pallet has two striking pallet-stones 2 and 3, forming trigger finger-pieces 9. It is clear that, because of the striking pallet-stones 2 and 3, striking pallet 8 releases the strike wheel, for a strike cycle, which, for example in the case of FIG. 1, is ⅙th of a revolution, i.e. an angular sector of 60° of strike wheel 11. Preferably, strike striking pallet 8 includes at least one tooth 9 with a radial travel relative to the strike wheel, or a circular travel that interferes therewith, or similar.

Each cam path of strike wheel 11, said cams being preferably formed by teeth 12 cooperates with a hammer lever 4, 4A respectively in the example of FIG. 1, corresponding to the gong 13, 13A respectively, that it has to work. This hammer lever 4, 4A is returned by resilient return means, notably a spring, towards an idle position. When strike wheel 11 is allowed to rotate by strike striking pallet 8, one of teeth 12 of strike wheel 11 cooperates with a tooth of hammer lever 4, 4*a*, transmits thereto part of the energy provided by the strike spring, moving it from the return position, and then drops it again, thus allowing the strike on gong 13, 13A.

The present invention proceeds from the general inventive idea which consists in checking, after a strike sequence, the torque remaining in the mechanism providing energy for the striking work, comprising a strike mainspring for watches and table clocks, and weights for clocks.

If the measured remaining torque is sufficient to allow the next strike sequence to occur properly, the strike sequence in progress is allowed to finish normally, and the striking mechanism returns to its position for the next strike sequence. If not, the striking work is locked and prevented from being released.

According to the invention, the torque measuring device 10 for stopping the strike of a striking mechanism includes at least one movable torque measuring lever 1, the trajectory of which interferes, at least indirectly, with that of a strike wheel 11, and which is arranged to be pivoted by said wheel. This torque measuring lever 1 is permanently subject to a resistant force of determined value against a drive force exerted on the torque measuring lever 1 by strike wheel 11 during rotation thereof. The torque measuring lever 1 blocks the rotation of strike wheel 11 if the drive force is less than the resistant force of determined value, and otherwise allows strike wheel 11 to rotate by releasing said wheel.

The torque measuring lever 1 according to the invention may be movable in different ways: by pivoting according to the preferred embodiment illustrated in the Figures, by bending, translation, or in any combined movement, provided that it is still subject to this resistant force of determined value, and that it can occupy at least one position wherein it locks strike wheel 11, and at least one position of release wherein it allows said wheel to rotate.

Figure 2:
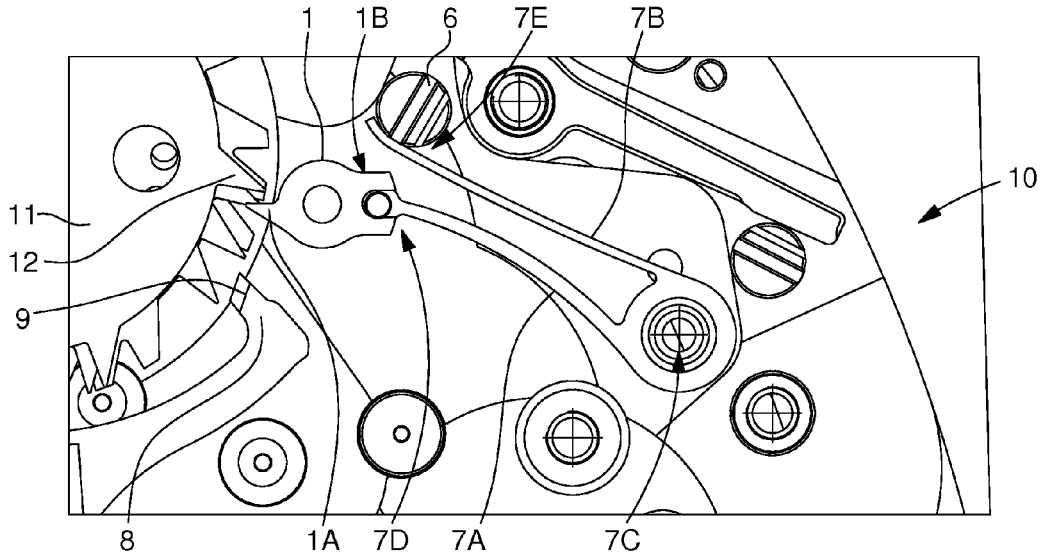
FIG. 2 is a similar diagram to FIG. 1, of a second embodiment of the invention, in a position in which the torque measuring device according to the invention is stopping a strike wheel from rotating.
Figure 3:
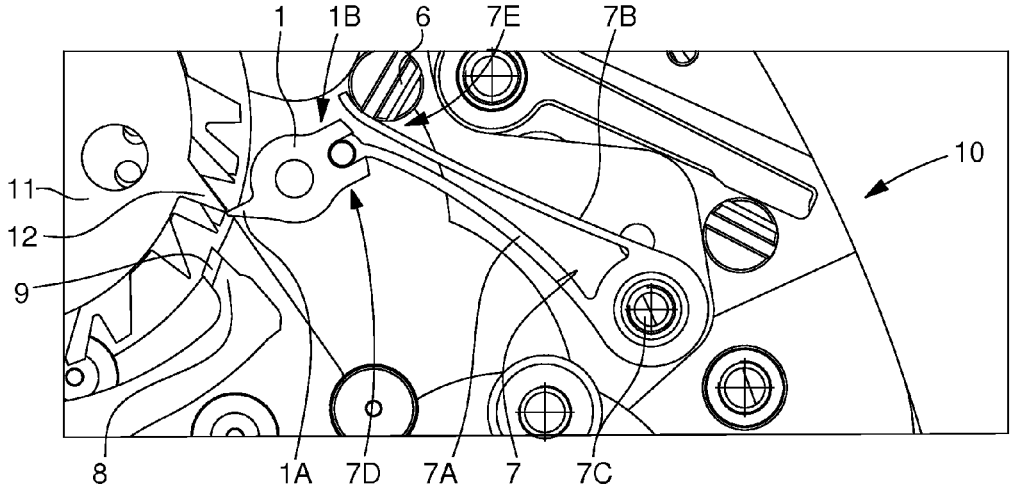
FIG. 3 is a diagram of the mechanism of FIG. 2, of a second embodiment of the invention, in a position in which the torque measuring device according to the invention is allowing a strike wheel to continue to rotate.

After the automatic strike, i.e. after cooperation of one tooth 12 of strike wheel 11 with a hammer lever 4, 4A, to make gong 13, 13A resonate, strike wheel 11 comes into contact with a torque measuring lever 1. The latter is subject to the action of a resistant torque, capable of exerting thereon a resistant force torque of a determined value. Preferably, this resistant force is provided by a spring 7 acting on torque measuring lever 1. The latter is preferably pivotally mounted, and may take the form of a torque measuring wheel, as seen in the Figures. Torque measuring lever 1 may also be formed by a pivoting part, or similar element. Transmission of the resistant force to torque measuring lever 1 may occur either via a pivot, as seen in FIG. 1, or by friction on a path 1B of the torque measuring lever, as seen in FIGS. 2 and 3. Other torque measuring lever 1 and other means of applying the resistant force may be envisaged without departing from the spirit of the invention. Torque measuring lever 1 is thus permanently subject to a resistant force of determined value against a drive force exerted by strike wheel 11 during rotation thereof.

If the drive force of strike wheel 11 is sufficient for torque measuring lever 1 to pass, this means that there is enough torque for a future strike, and strike wheel 1 continues on its path towards the release system including striking pallet 8, to wait for the next strike release.

If the drive force is insufficient for torque measuring lever 1 to pass, strike wheel 11 is locked, and the future release will be inoperative.

In the event of a shock, if torque measuring lever 1 releases strike wheel 11 because of the shock, no strike will take place. The wheel will go up to the trigger point and will strike properly at the exact time.

When the striking mechanism is wound, the torque reserve of the energy source is renewed, and torque measuring lever 1 releases strike wheel 11. No strike occurs, strike wheel 11 will go up to the trigger point and will strike at the next exact time.

Advantageously, the resistant force applied to torque measuring lever 1 is adjustable. In the case of a spring 7, the calibration is easily adjusted by adjustable calibration means, or an eccentric screw 6, seen in the Figures, or suchlike.

During the occurrence of a strike sequence, during which the strike striking pallet 8 allows strike wheel 11 to strike, each tooth 12 thereof will abut, in succession, on torque measuring lever 1.

If, at the end of the strike sequence, the torque remaining in the drive spring of strike wheel 11 is sufficient to allow the next strike sequence to occur in its entirety, tooth 12 of strike wheel 11 overcomes the resistance of torque measuring lever 1 and escapes therefrom, before being locked on trigger finger-piece 9 of striking pallet 8, or when another of teeth 12 of strike wheel 11 is abutting on striking pallet 8. The mechanism then allows the strike cycles to continue.

Otherwise, if the torque reserve of the drive spring of strike wheel 11 is insufficient to stop the torque measuring wheel or lever 1, the latter locks strike wheel 11 in position, until the torque is sufficient, notably by the strike spring being wound.

Returning to the example of FIG. 1, where the strike cycle takes place over an angular sector of 60° of strike wheel 11, the actual strike, of two times three sounds, resulting from the three toothings on each of the two superposed wheels, only occurs on part of this angular sector, for example 50°. The remaining part, which is 10° here, is dedicated to the torque measurement by lever 1: if the remaining drive torque is sufficient for the proper execution of the entire following strike sequence, and is thus greater than the torque applied to lever 1 by resistant force, here from spring 7, the strike cycle can finish on striking pallet stone 2. Conversely, if the drive torque is insufficient, the system remains suspended on lever 1, via the toothing thereof, waiting for winding or for the energy source to be recharged. The advantage of this system is that it takes its position and is active at the end of the strike cycle. If, in the event of a shock, the system of strike wheel 11 is released, it will abut on striking pallet-stone 2 without any action on the hammers. In an alternative embodiment, torque measuring lever 1 is stepped, and each step corresponds to a cam path of strike wheel 11, or different strike wheels, with which it cooperates.

In a preferred embodiment seen in FIG. 1, the resistant force is applied to the torque measuring lever by a leg of a support spring 7. Preferably, the latter is a U-shaped support spring, pivotally mounted at a loop 7C comprised therein between the two branches of the U. One of the branches 7A cooperates with torque measuring lever 1 and the other branch 7B cooperates with adjusting calibration means or with an eccentric screw 6.

Preferably, the stiffness of the two branches of spring 7 is different. There is a large beam at the point of abutment on lever 1, and a much thinner branch at adjusting cam 6. Indeed, the spring must be strong enough to be close to the maximum strike torque, for example 250 g/mm in the example of FIG. 1, and so that the spring can react when the drive torque decreases, at the moment when one wishes the strike to stop, for example after the fifteenth hour on an eighteen hour mechanism.

In another variant, torque measuring lever 1 is formed directly by part, particularly an end, of a spring and notably a spring of the aforementioned type. In this particular case, the torque measuring lever 1 is not movable by pivoting, but by bending, under the influence of the contradictory drive torque and resistant torque.

In a particular variant, torque measuring lever 1 includes a single cooperation surface with the strike wheel 11 with which it cooperates, even if the latter has several cam paths.

In an advantageous embodiment, torque measuring lever 1 is combined with strike striking pallet 8 and carried by the same.

Preferably, the resistant force of determined value is calibrated with an equal value and in the opposite direction to the drive force necessary for executing a complete strike sequence.

Preferably, torque measuring lever 1 is pivotally mounted on an arbour 1C situated outside the area of strike wheel 11 and parallel to the arbour 11A thereof.

Advantageously, torque measuring lever 1 is coupled to an indicator that the user can read, and which warns of the need to recharge an energy source of a strike mechanism driving said strike wheel. This indicator may, in particular, be formed by a hand driven directly or indirectly by lever 1, or even by an all or nothing indication showing a sufficient or insufficient level of the strike mechanism energy source.

Preferably, as seen in the Figures, torque measuring lever 1 is a torque measuring wheel.

The invention further concerns a strike mechanism including a rechargeable energy source and a striking pallet 8 which, at times planned by said mechanism and/or the user thereof, allows at least one strike wheel 11 to be driven using part of the energy transmitted by said energy source to cause at least one gong 13 to resonate, and including at least one such torque measuring device 10.

The invention also concerns a timepiece including at least one such strike mechanism.

What is claimed is:

1. A torque measuring device arranged to stop a strike of a striking mechanism including a rechargeable energy source and a striking pallet, which, at times planned by the striking mechanism, allows at least one strike wheel to be driven using part of the energy transmitted by the energy source to actuate at least one hammer on at least one gong, wherein the torque measuring device includes:

(a) at least one movable torque measuring lever, wherein a trajectory of the at least one movable torque measuring lever interferes with a trajectory of the at least one strike wheel, and the at least one movable torque measuring lever is arranged to be driven by the at least one strike wheel, wherein the at least one moveable torque measuring lever is permanently subject to a resistant force of determined value against a drive force exerted on the at least one moveable torque measuring lever by the at least one strike wheel during rotation thereof, and the at least one moveable torque measuring lever blocks rotation of the at least one strike wheel when the drive force is less than the resistant force of determined value, and otherwise the at least one moveable torque measuring lever allows the at least one strike wheel to rotate by releasing the at least one strike wheel.

2. The device according to claim 1, wherein said resistant torque is applied by friction on a path of said at least one moveable torque measuring lever.

3. The device according to claim 1, wherein said resistant torque is applied at a pivot of said at least one moveable torque measuring lever.

4. The device according to claim 1, wherein said resistant force is applied to said at least one moveable torque measuring lever by a leg of a support spring.

5. The device according to claim 4, wherein said support spring is a U-shaped support spring, pivotally mounted at a loop disposed therein between the two branches of the U, wherein one of the two branches cooperates with said at least one moveable torque measuring lever and the other branch of the two branches cooperates with adjustable calibration means or with an eccentric screw.

6. The device according to claim 1, wherein said at least one moveable torque measuring lever includes a single cooperation surface with said at least one strike wheel with which said at least one moveable torque measuring lever cooperates.

7. The device according to claim 1, wherein the at least one moveable torque measuring lever is combined with said striking pallet.

8. The device according to claim 1, wherein the resistant force of determined value is of equal value, and has an opposite direction to, the drive force necessary for executing a complete strike sequence.

9. The device according to claim 1, wherein said at least one moveable torque measuring lever is pivotally mounted on an arbour situated outside an area of said at least one strike wheel and parallel to that of said at least one strike wheel.

10. The device according to claim 1, wherein said at least one moveable torque measuring lever is movably mounted in translation.

11. The device according to claim 1, wherein said at least one moveable torque measuring lever has a same number of steps as the number of cam paths comprised in said at least one strike wheel for making different gongs resonate.

12. The device according to claim 1, wherein said at least one moveable torque measuring lever is coupled to an indicator that a user can read and that warns of a need to recharge the energy source of the striking mechanism driving said at least one strike wheel.

13. The device according to claim 1, wherein said at least one moveable torque measuring lever is a torque measuring wheel.

14. A striking mechanism including:

a rechargeable energy source and a striking pallet which, at times planned by the striking mechanism, allows at least one strike wheel to be driven using part of energy transmitted by the energy source to actuate at least one hammer on at least one gong; and the at least one movable torque measuring lever of the torque measuring device according to claim 1.

15. A timepiece including at least one striking mechanism according to claim 14.

* * * * *